US007849936B2

(12) United States Patent
Hutton

(10) Patent No.: US 7,849,936 B2
(45) Date of Patent: Dec. 14, 2010

(54) STEERABLE ROTARY DIRECTIONAL DRILLING TOOL FOR DRILLING BOREHOLES

(75) Inventor: Richard Hutton, Bristol (GB)

(73) Assignee: Meciria Limited, Nottinghamshire (GB)

( * ) Notice: Subject to any disclaimer, the term of this patent is extended or adjusted under 35 U.S.C. 154(b) by 512 days.

(21) Appl. No.: 11/891,541

(22) Filed: Aug. 10, 2007

(65) Prior Publication Data

US 2008/0000693 A1 Jan. 3, 2008

(51) Int. Cl.
*E21B 7/08* (2006.01)

(52) U.S. Cl. ..... 175/61; 175/76; 175/267

(58) Field of Classification Search ..... 175/76, 175/61, 267

See application file for complete search history.

(56) References Cited

U.S. PATENT DOCUMENTS 5,060,736 A * 10/1991 Neff ..... 175/74
5,232,058 A * 8/1993 Morin et al. ..... 175/73
5,341,886 A 8/1994 Patton
5,553,678 A 9/1996 Barr et al.
6,206,108 B1 3/2001 MacDonald et al.
2005/0056463 A1 * 3/2005 Aronstam et al. ..... 175/61

FOREIGN PATENT DOCUMENTS

EP 0 497 420 8/1992
EP 0685 623 A3 1/1997
GB 2 285 651 7/1995

* cited by examiner

*Primary Examiner*—Giovanna C Wright
(74) *Attorney, Agent, or Firm*—Weide & Miller, Ltd.

(57) ABSTRACT

A directional drilling apparatus for use in the directional drilling of bore holes is disclosed. The apparatus comprises a plurality of cutting elements movably mounted with respect to a rotatable body member, wherein the cutting elements are movable between first, radially retracted, positions and radially extended, positions for cutting. A rotary valve is provided for synchronising the movement of the cutting elements between their respective extended and retracted positions in accordance with the rotational position of the body member in the bore hole being drilled. Control of the directional drilling system is affected by synchronised movement of the cutting elements from an inner to an outer radial position in accordance with the angular position of the drill bit. A near bit stabiliser contacts with the portion of the well bore which was not removed with the dynamic cutters and this contact exerts a force onto the drill bit.

47 Claims, 11 Drawing Sheets

STEERABLE ROTARY DIRECTIONAL DRILLING TOOL FOR DRILLING BOREHOLES

PRIOR APPLICATION DATA

This application claims priority to PCT Application No. PCT/GB2006/000490, entitled Steerable Rotary Directional Drilling Tool For Drilling Boreholes which was published as WO 2006/085105 and which is based on and claims priority to Great Britain patent application number 0503742.9 filed Feb. 11, 2005.

FIELD OF THE INVENTION

This invention relates to a directional drilling tool for drilling boreholes into the earth.

BACKGROUND

Drilling of bore holes is conducted for the exploration and production of hydrocarbon fuels, for example in gas and oil exploration and production. The term 'directional drilling' is used to describe the process of drilling a bore hole which is directed, for example, towards a target or away from an area where the drilling conditions are difficult. A directional drilling tool generally sits behind a drill bit and forward of measurement tools. The complete system of bit, directional and measurement tools is called the bottom hole assembly or BHA. Currently there are two main types of directional drilling tool, namely positive displacement mud motors and rotary steerable directional drilling tools.

Positive displacement mud motors are placed in the bottom hole assembly behind the drill bit and operate in either a 'sliding' or 'rotating' mode. When in sliding mode the drill string is held stationary at the surface. Fluid is then pumped through the positive displacement motor which is situated above the drill bit and connected to the drill bit by a drive shaft and universal joint. Generally there is a fixed bend in the collar between the bit and motor in order to offset the drill bits axis of rotation with the axis of rotation of the BHA. The drill bit will then tend to head in the direction of the bend. By controlling the angle of the bend relative to the formation being drilled, the drilling direction can be controlled. However, the angle of the bend can only be controlled from the surface and measurements of the bend position, commonly known as tool face angle, are sent to the surface using some form of up-hole communication device. As drilling progresses the BHA advances forward and the rest of the drill string slides along the well bore, hence the term 'sliding'.

In order to control the rate of turn of the well bore being drilled, the drill string is rotated from the surface while the motor is rotating the drill bit. This effectively cancels the effect of bend between the motor and drill bit. The drill bit will thus head straight ahead. This is commonly known as rotating.

This method of directional drilling, alternating between rotating and sliding, is slower than continual rotation of the drill string from the surface due to the torque limitation of mud motors, and hence slow rates of penetration are achieved when operating in the sliding mode.

Directional drilling while continually rotating the drill string offers the following advantages: better hole cleaning; smoother well bores, extended reach drilling and higher rates of penetration. However, these tools are often complex in design and hence are costly to manufacture and operate.

For example, UK patent application GB2259316 describes a modulated bias unit for steerable rotary drilling systems. The modulated bias unit comprises one or more pads which press against the side of the formation being drilled to exert a lateral force on the drill bit. By controlling the direction of the force the drill bit can be steered into the required direction. This enables the drill bit to cut across as well as forwards and is commonly known as "push-the-bit".

Another method involves pointing the bit in the intended drilling direction. For example, International patent application WO0104453 describes a method of deflecting a bit shaft, which runs through the centre of the drilling tool. Deflecting the shaft angles the bit with respect to the remaining parts of the BHA. The bit shaft can be permanently deflected and the position of the deflection controlled, or both the position and magnitude of the deflection can be controlled. These systems typically use a non rotating sleeve which presses against the formation which can be problematic if the hole is drilled slightly over gauge (over size).

"Point-the-bit" drilling can also be performed by contra-rotating a bit shaft in a fixed radius and at a rotation rate equal but opposite to the drill string rotation. For example, International patent application WO9005235 describes such an arrangement. Again this offsets the bit axis of rotation relative to the rest of the BHA and the drill bit will tend to move in the direction of the off-axis offset.

SUMMARY

According to an aspect of the invention there is provided a directional drilling device for use in drilling boreholes, the device being positionable between a drill bit and associated drill collar of a drill string having a longitudinal drilling axis; the device comprising: at least one cutting member movably mounted with respect to a tool body member, and the cutting member(s) is moveable between a first extended position for engagement with the wall of a bore hole and a second position in which it is retracted from engagement with the wall. In addition, directional control means are provided for synchronising the movement of the cutting member(s) between the respective extended and retracted positions in accordance with the rotational position of the body member in the bore hole being drilled.

According to another aspect of the present invention, there is provided a directional drilling device for use in drilling boreholes, the device being positionable between a drill bit and associated drill collar of a drill string having a longitudinal drilling axis. In this embodiment, the device comprises a body member having one or more cutting members for rotation about the drilling axis such that the one or more cutting members are mounted for movement between a first position in which each engages the wall of a bore hole and a second position in which it is retracted from engagement with wall. In addition, the device having connection means can be connected to means capable of selectively remotely controlling movement of the one or more cutting members between the first position and the second position when required to alter direction of the drilling axis.

In another aspect of the present invention, there is provided a directional drilling device for use in drilling boreholes such that the device is positionable between a drill bit and associated drill collar of a drill string having a longitudinal drilling axis. In this embodiment, the device comprises a body member having one or more cutting members for rotation about the drilling axis. The one or more cutting members may be mounted for movement between a first position in which each engages the wall of a bore hole and a second position in which it is retracted from engagement with wall. This embodiment also includes movement controlling means for selectively remotely controlling movement of the one or more cutting members between the first position and the second position when required to alter direction of the drilling axis.

In a further aspect of the present invention, there is provided a drilling tool comprising a hollow drill collar for coupling at an operative end of a drill string when in use and rotatable with the drill string about a longitudinal drilling axis. In this embodiment a drill bit is provided at one end of the drill collar and a directional drilling device provided in or on the collar adjacent and rearward of the drill bit. The directional drilling device comprising a body member having one or more cutting members rotatably mounted about the drilling axis for movement between a first position in which the cutting member(s) engage a wall of the bore and a second position in which they are retracted from engagement with the wall. This embodiment also comprises movement controlling means for selectively remotely controlling movement of the one or more cutting members between the first position and the second position when required to alter direction of the drilling axis.

Control of the directional drilling system may be effected by the synchronised movement of movable drilling cutters from an inner to outer radial position in accordance with the angular position of the drill bit. For example, by deploying the dynamic cutters over a 240° period, an eccentric channel about the longitudinal axis of the BHA, and parallel thereto, will be produced. As drilling progresses a near bit stabiliser, located above and behind the dynamic cutters, contacts with the portion of well bore which was not removed with the dynamic cutters, i.e. the concentric part. This contact exerts a force onto the near bit stabiliser which is reacted by the drill bit and another stabiliser further up the drill string. The reaction force between the drill bit and the formation results in a side cutting force on the drill bit and hence deviation of the drill bit is achieved.

In one embodiment, a complete Bottom Hole Assembly (BHA) comprises a drill bit of the type commonly used for drilling well bores, a directional drilling tool comprising a device according to an embodiment of the present invention and a series of either collars or other measurement tools. For the purpose of this description all tools above the directional drilling tool will be simply known as collars. The directional drilling tool preferably comprises a plurality of cutters which are normally biased outwardly and moved between inner positions and their outer radial positions in synchronism with the rotation of the BHA. Thus, as previously stated, by controlling the synchronous movement of the cutters in relation to the rotation of the drill string, an elongate arcuate channel will be produced behind the drill bit. As drilling progresses, the stabiliser, which has a larger radial diameter than the movable cutters, when the latter are in their inner radial positions, contacts the well bore. By controlling the orientation of the eccentric channel with respect to the well bore directional control of the well bore can be maintained. The drilling tool is directed in the direction of the eccentric channel cut by the movable cutters, that is to say the drilling tool is subsequently steered in the direction of the eccentricity defined by the axis of rotation of the movable cutters. Disclosed herein is a directional drilling tool for drilling into the earth.

When using a drill having a cutting diameter of say 14 cms, drill collars are typically of a length of about 10 meters and are coupled together by screw couplings. Though formed of robust materials such as steel they are flexible to an extent enabling approximately 3° per length of pipe section. In consequence, in this instance, approximately a minimum 300 meters of drill string length is required to negotiate a 90° turn in direction under the influence of the forces acting on the drill bit. For other drill diameter and end collar lengths, different considerations may apply.

In a further aspect of the invention, there is also provided a method of controlling the direction of drilling axis of a rotatable boring drill bit of a drill string comprising a plurality of hollow drill collars on a drilling end of which the bit is mounted, at least one movable cutter being mounted on or in the pipe adjacent the drill bit around an axis of rotation of the drill string, the at least one cutter being mounted for movement between a first position in which it engages the wall of a bore hole in which the drill bit is moving and a second position in which it is retracted from engagement with the wall, and controllably moving the at least one movable cutter as the drill is rotated so that movement of the at least one movable cutter is synchronised with that of the drill so that the at least one movable cutter is selectively engaged with the wall at a preselected region thereof to form a linear channel therein parallel to the drilling axis when it is desired to cause the path of the drill bit to deviate from a linear direction of movement. The channel is linear in the sense that it extends parallel to the longitudinal direction of the well bore being drilled. The cross-section of the channel in the plane perpendicular to the longitudinal drilling axis is such that it defines part of an eccentric circle offset from, and therefore superimposed on, the circular cross-section of the well bore cut by the main cutters of the drill bit. This effectively provides the eccentric part of the bore hole with a crescent shape when viewed in the plane perpendicular to the drilling direction.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views. Embodiments of the present invention will now be more particularly described, by way of example only, with reference to the accompanying drawings, in which.

DETAILED DESCRIPTION

Figure 1:
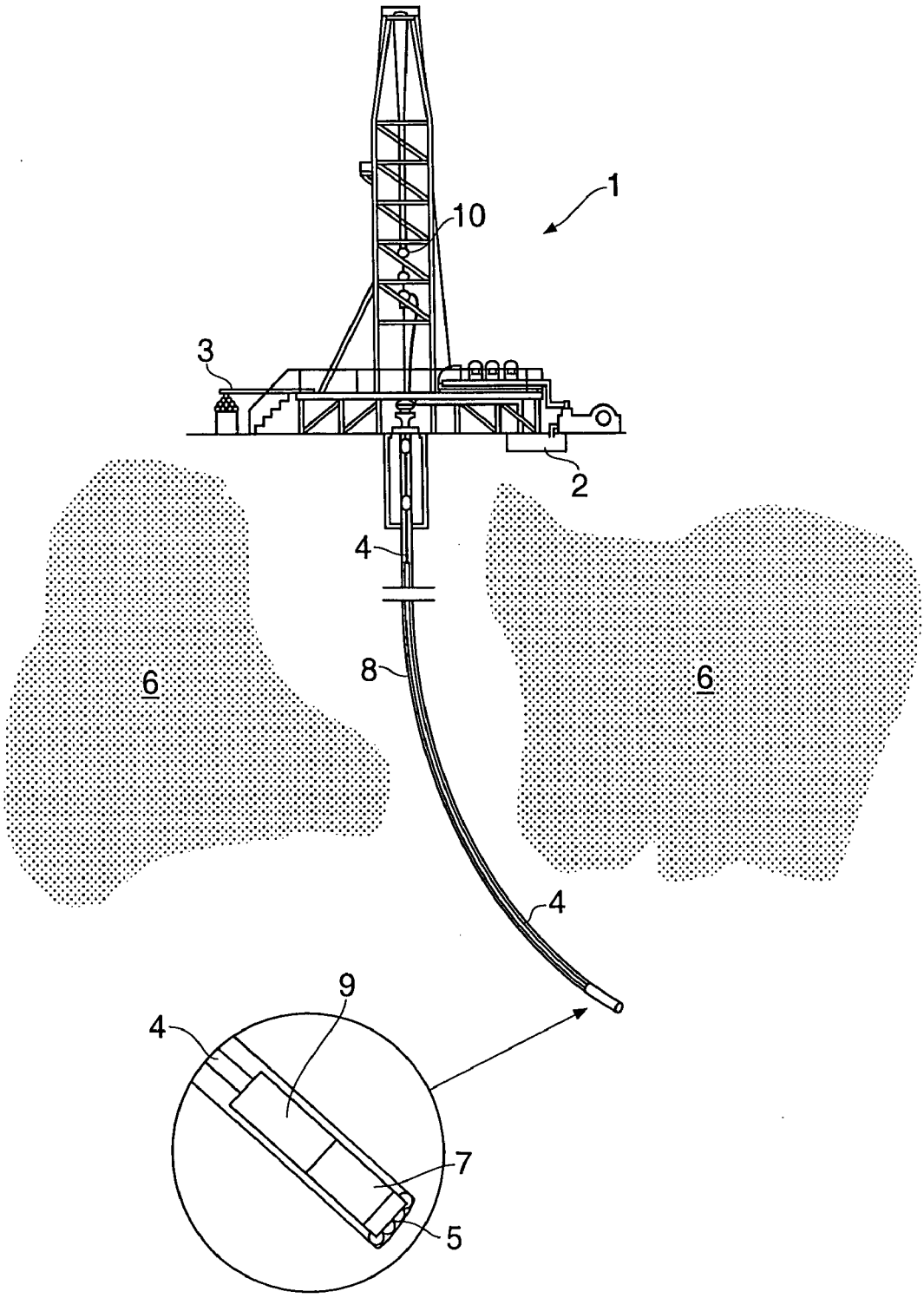
FIG. 1 is a schematic illustration of a deep hole drilling installation in which a directional drilling system is used.

Referring to FIG. 1, it is commonly used practice in direction drilling to use a Bottom Hole Assembly (BHA) consisting of a drill bit 5 to cut the rock, a tool 7 to steer the drill bit and a measurement tool 9 to monitor the position of the resulting well bore. The BHA is connected to the surface through a series of pipes or collars 4 (known as a 'drill string') and is rotated by either a rotary table or top drive which is part of the drilling rig 1. The drilling string is raised and lowered and weight-on-bit (WOB) is applied by controlling the draw works 10. A fluid is pumped from a storage tank 2 at the surface through a pipe 3 and into the drill string 4. The fluid travels through the drill string and exits through ports in the drill bit. This fluid then travels back to the surface on the outside of the drill string and back into the storage tank 2. As is well known in the art of drilling, fluid is used to lift the cuttings of rock produced by the drill bit back to the surface. The drilling fluid also cools and lubricates the drill bit and can be used as a source of hydraulic power for powering tools in the BHA.

Figure 2:
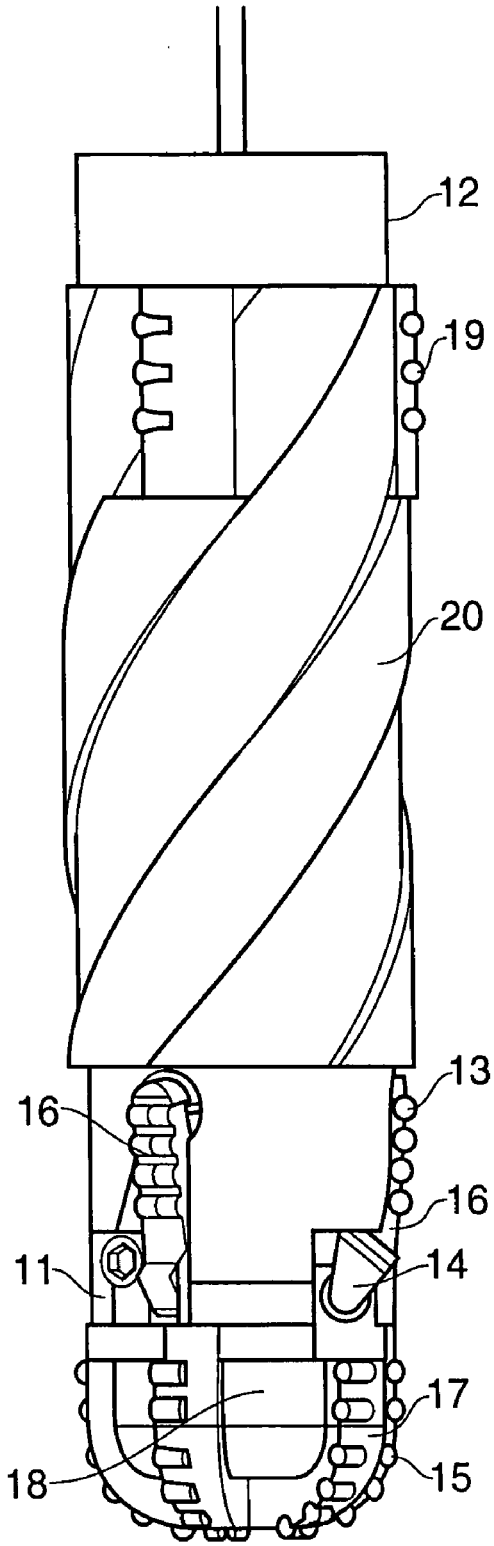
FIG. 2 shows a directional drilling system including a dynamic cutter of a device according to an embodiment of the present invention.

Referring to FIG. 2, there is shown a directional drilling system according to a first embodiment of the present invention. A drill bit body 12 comprises a set of primary blades 17, attached to which, in a known manner, are super hard cutting elements 15 of a material such as polycrystalline diamond. Polycrystalline diamond (PCD) consists of a layer of diamond integrally bonded to a carbide substrate. The diamond layer provides high hardness and abrasion resistance, whereas the carbide substrate improves the toughness and weldability.

Adjacent to each blade 17 is a so called junk slot 18 to allow the passage of fluid and cuttings back to the surface. The drill bit body could have any number of blades and corresponding junk slots; the example shown consists of five equally spaced around the tip of the drill bit.

Cutting means, provided by a plurality or set of movable or dynamic cutters 16, is also provided which can be moved between inner, or retracted, positions to more radially outward, or outer, radial positions in a synchronised manner during rotation of the drill bit body. When in use, these cutters are normally biased, as explained below, in their radially outer, first positions. In a similar manner to the blades 17, elements 13 of super hard material are attached to the movable cutters 16 to cut the rock formation. The movable cutters pivot about a point 14 down-hole of their respective cutter face, that is to say at their end nearest the tip of the drill bit remote from the cutter face elements 13. Alternatively, the pivot point 14 could be higher or further up-hole than the cutting face. The drill bit body may contain any number of dynamic cutters equally spaced around the periphery of the drill bit body; in this example three are used. In an alternative embodiment the dynamic cutters may also be spaced in a non-equal manner if required. In present invention also contemplates embodiments having only a single dynamic cutter 16.

The movable or dynamic cutters 16 are inserted into respective mounting holes in the drill bit body, described in more detail below, which prevent vertical and lateral movement of the cutters. The movable cutters 16 are prevented from falling out of their respective holes by a stop block 11 (FIG. 3) which is attached to the drill bit body.

A near bit stabiliser comprising a series of helically-formed blades 20, as is commonly used in directional drilling tools, is attached to the drill bit body 12. In this example the near bit stabiliser is shown with three helically-shaped blades. A set of gauge cutters 19 is mounted on the radially outer surface of the near bit stabiliser, towards the end of the drill bit body remote from the drill bit tip, to finish or gauge the hole diameter. The gauge cutters 19 could also be mounted elsewhere on the drill bit body in a known manner. The near bit stabiliser has an internal thread (not shown) for threaded engagement with an external thread (not shown) on the drill bit body 12.

Figure 3:
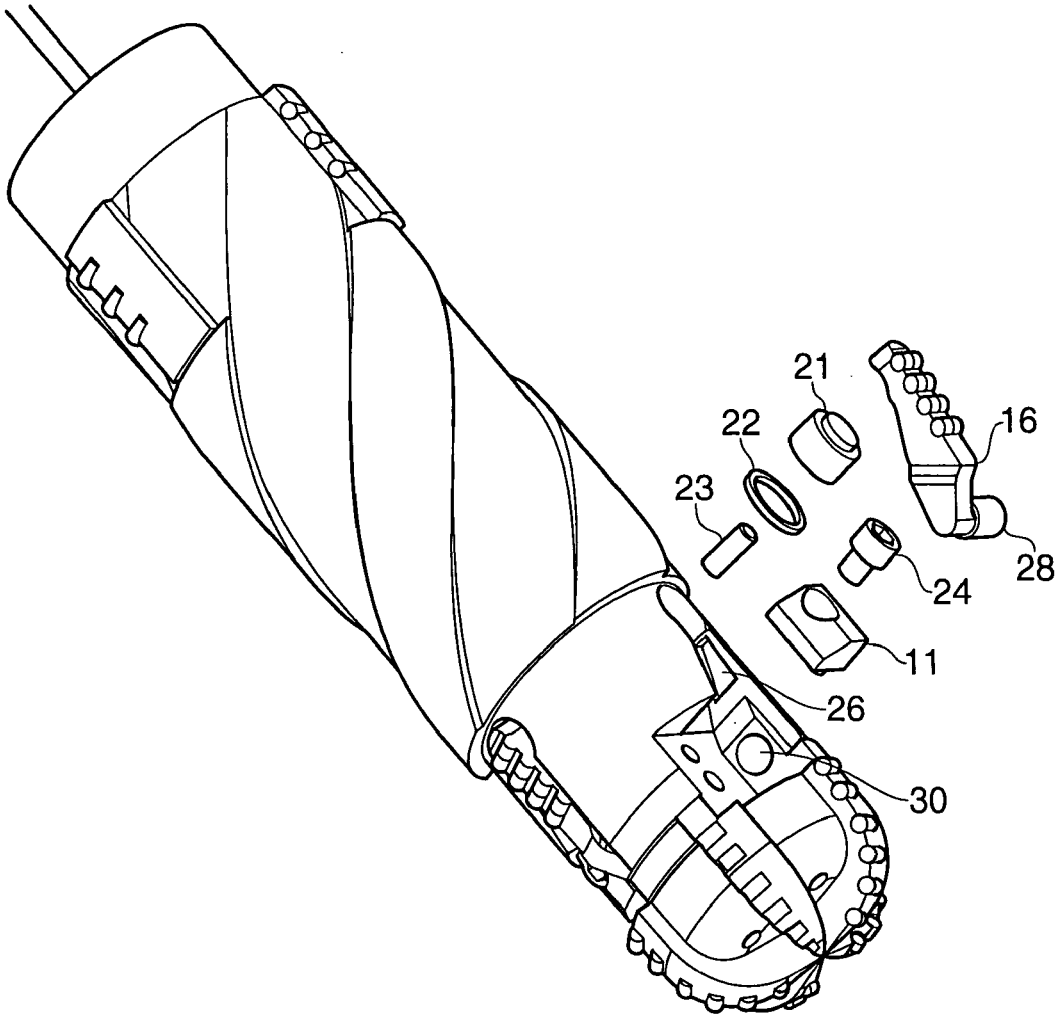
FIG. 3 is a part exploded detailed perspective view of the direction drilling system and dynamic cutter of FIG. 2.

FIG. 3 shows an exploded view of one of the dynamic cutters 16 and associated component parts. As previously described, the dynamic cutters 16 are each pivotally mounted on the drill bit body. The dynamic cutters 16 are each provided with a circular cross-section cylindrical stub shaft 28 which projects perpendicularly from the main body portion of the cutter. The stub shaft 28 is received in a cylindrical bore locating hole 30 in the drill bit body. A hard wearing material is preferably used on either the dynamic cutter pivot shaft 28 or drill bit body locating hole 30 to reduce wear due to relative movement of these components in use. The pivot locating hole 30 could also consist of a soft sacrificial sleeve. The retaining block 11 is fastened to the drill bit body by means of a threaded fastener 24, which may be a bolt. The dynamic cutter locating hole 30 and retaining block 11 prevent all lateral movement of the dynamic cutter with respect to the drill bit body.

Each dynamic cutter 16 is, when in use, biased to its first, outer, radial position by a respective piston 21. The piston comprises a blind bore 100 (FIG. 6) which receives a guide pin 23 attached at one end to the drill bit body in a known manner, for example by means of a compression fit. The piston 21 is slidably mounted on the other end on the guide pin 23 for movement along the pin in a cylinder type cavity 44 in the drill bit body. A piston seal 22, described in more detail below, is located in a circumferential slot in the cylinder wall in the drill bit body. The seal 22 prevents fluid escaping past the piston.

Radial movement of the dynamic cutter about its pivot axis 14 is restricted by contact with a cut out portion 26 in the drill bit body and the dynamic cutter retaining stop 29 (see FIG. 4) when the cutter is at its maximum deployed position. The dynamic cutter is returned to its second, inner, radial position due to the vertical weight on bit (WOB) force acting on the cutter. Additional assistance could be provided by mechanical means such as a return spring or springs to return the cutter to its retracted position when the hydraulic pressure acting on the piston is removed. An alternative embodiment of the present invention, discussed hereinafter with reference to FIG. 6A, provides for use of hydraulic pressure to assist in returning the cutter to its second, radially-inner, position.

Figure 4:
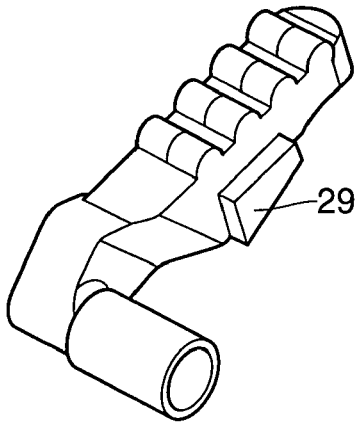
FIG. 4 shows a dynamic cutter blade of the dynamic cutter of FIGS. 2 and 3.

FIG. 4 shows one of the dynamic cutters 16 in more detail showing a radial movement limit stop 29 on the same side of cutter as the pivot mounting shaft 28. The stop 29 is arranged to contact a similar sized cut out 26 in the drill bit body to limit the extent of the pivotal movement of the cutter when deployed.

Figure 5:
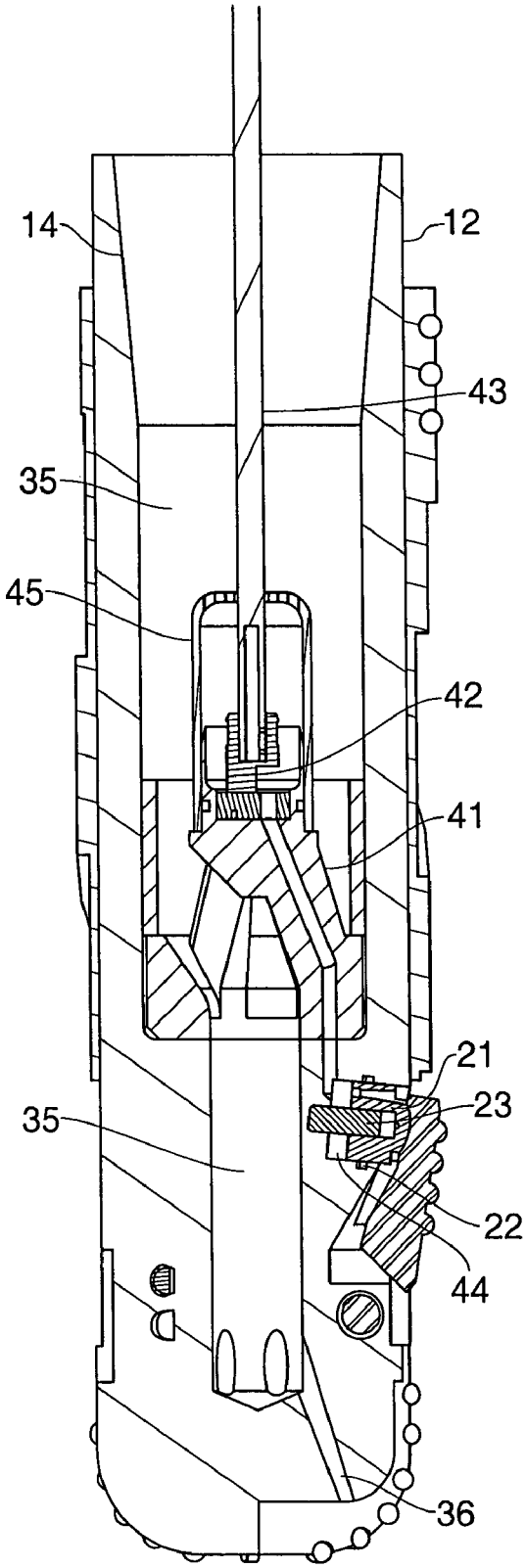
FIG. 5 is a cross-section view of the drilling system and dynamic cutter of FIGS. 2 and 3.

FIG. 5 is a cross-section view through the longitudinal axis of the drill bit body 12. An up hole connection 14 is shown for connection of the drill bit body to another drilling tool, for example a measuring tool. The drill bit body comprises a central through passage 35 for the passage of drilling fluid through the tool to the down-hole end of the drill bit body where it exits the tool. As is commonly known nozzles or restrictors can be inserted into the bottom of the drill bit body to restrict the flow rate of fluid through the tool and create a high pressure zone within the drill bit body and a low pressure zone outside the drill bit body. The drill bit body according to the illustrated embodiment comprises a plurality of nozzles 36 at the drill tip end of the drill bit body.

As previously mentioned, the movable cutters 16 are deployed from their second inner, positions to first, radially-outer positions by respective pistons 21 which are guided on pins 23 attached to the drill bit body. A rotary disc valve 42 is provided for diverting a portion of the fluid in the passage 35 to the piston chamber cavities 44 behind the respective pistons to deploy one or more pistons from their inner to outer radial position. The pistons use the relative high pressure of the fluid in the drill string entering the passage 35 as a source of hydraulic power. A filter 45 located at the downstream end of the passage 35 is used to remove particles from the fluid before that fluid can enter the valve 42, to prevent damage to the piston seals.

As previously mentioned, in use, direction control is achieved by the synchronous deployment of the dynamic cutters 16 from their inner to outer radial positions as the drill bit body rotates. The pistons are deployed by controlling the fluid flowing to them using the rotary disc valve 42 which is controlled by and attached to a shaft 43 extending along the longitudinal axis of the drill bit body from the valve 42 and passing through the upstream end of the drill body. A fluid distributor 41 is used to divert the fluid from the disc valve to the pistons in dependence on the angular position of the disc valve 42 with respect to the distributor.

In operation, the cutters 16 are normally deployed in their first, radially-outer positions so that they effectively enlarge the bore behind the drill bit. In this mode of operation, they are held in their radially-outer positions by hydraulic fluid supplied under pressure via the rotary valve 42. In this mode of operation, the valve 42 rotates 'out of phase' with the drill so that the cutters operate on the entire wall of the bore as they rotate. The cutters move in and out between their first and second positions but not in synchronisation with rotation of the drill itself. In consequence they act to enlarge the bore behind the drill itself.

However, when required to assist re-direction of the drilling axis, the rotational position of the rotary valve with respect to the drill is set by rotating the valve relative to the drill by means well known in the art, for example, a roll stabilised electronics platform or a strapped down electronics system could be used with an electric motor providing the rotational control for the rotary disc valve control shaft. In this way hydraulic fluid is only supplied to the pistons 21 during a fixed part of the rotation of the drill so that all of the cutters operate only on the same sector of the wall of the bore as the drill descends such that the dynamic cutters define an eccentric cutting axis offset from the main drilling axis of the drill. This is achieved by holding the rotary valve 42 geostationary once the valve has been rotated to an angular position within the borehole being drilled. This angular position is determined by the direction the drill string is to be steered.

Figure 6:
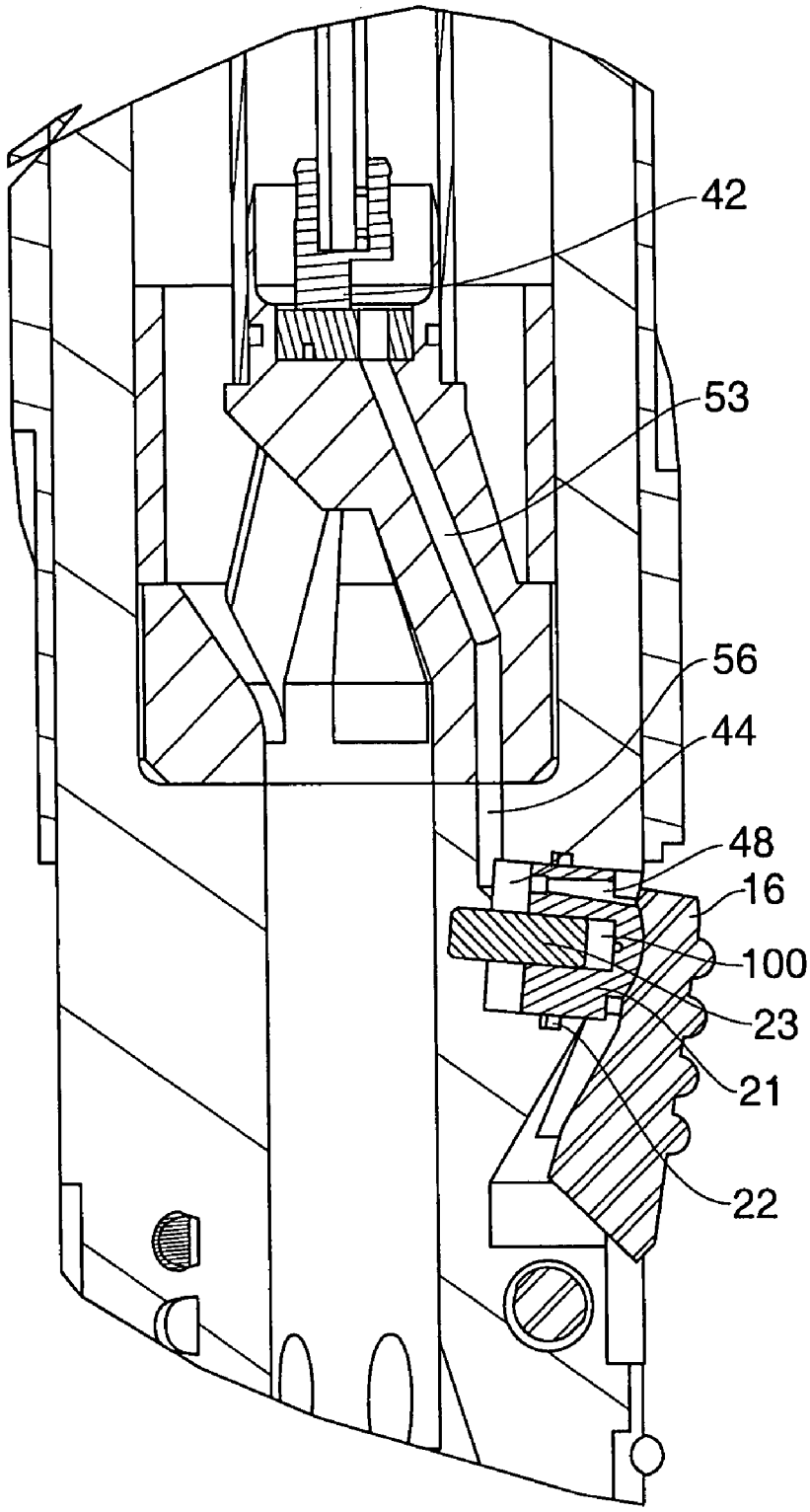
FIG. 6 is a detailed view of the dynamic cutter of FIG. 2 which shows a dynamic cutter deployed in an outer radial position.
Figure 6A:
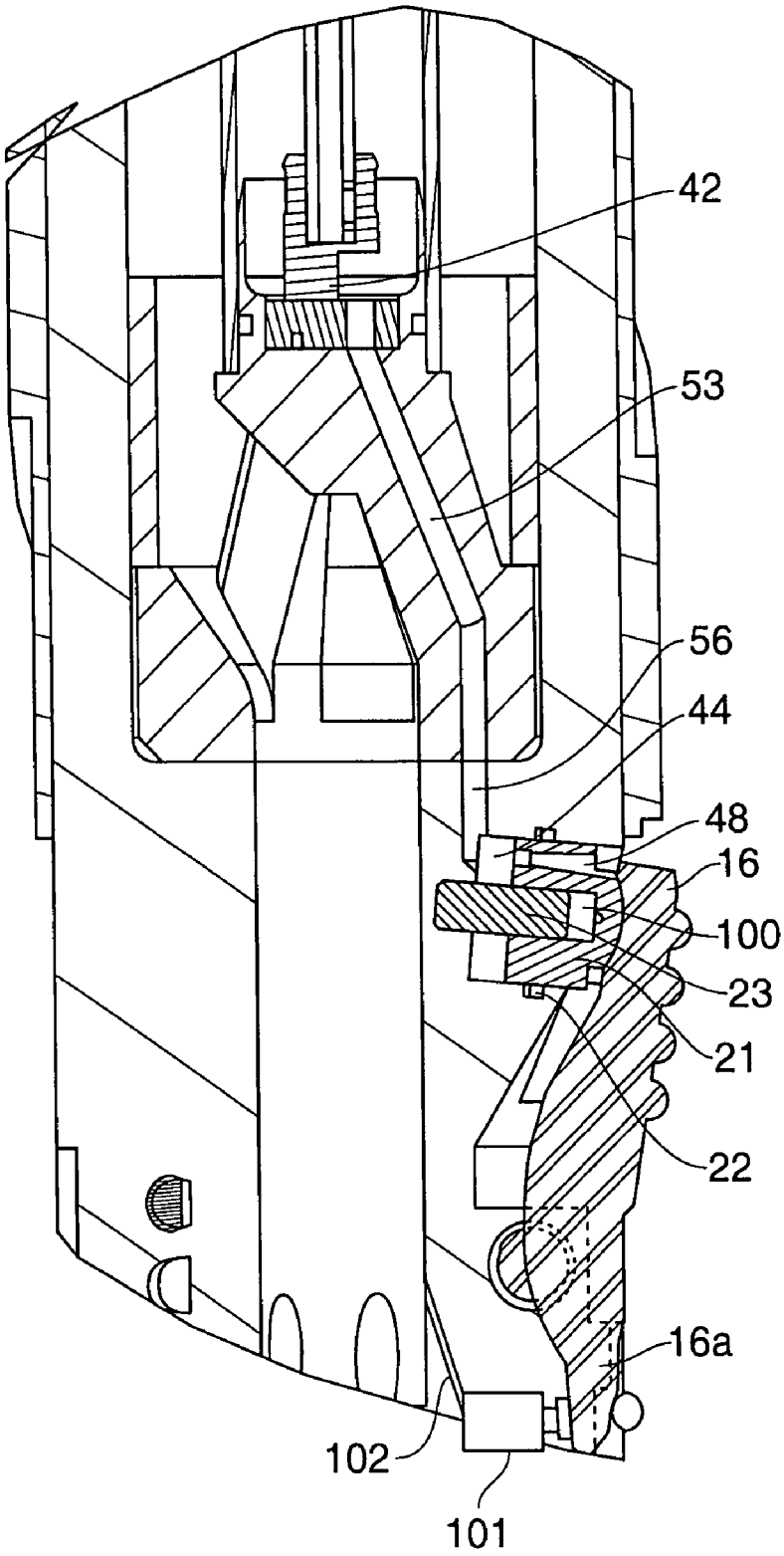
FIG. 6A is a detailed view, similar to that of FIG. 6, showing a second embodiment of the invention in which means is provided for urging a dynamic cutter to a retracted inner radial position.

Referring now to FIG. 6, this shows the manner in which the disc valve 42 operates; the disc valve 42 is in the open position for the cutter 16 shown in the drawing. In this position, the valve 42 allows the communication of fluid through the disc valve into a feed port 53 in the fluid distributor, then into a feed port 56 in the drill bit body and then into the cavity 44 behind the piston. The pressurised hydraulic fluid pushes the piston 21 forward on the guide pin 23 which causes the dynamic cutter 16 to be moved from its second, radially inner, position (FIG. 7) to its first radially-deployed, outer position (FIG. 6). The piston guide pin 23 is attached to the drill bit body in the centre of the cavity 44 between the drill bit body and the piston. The piston continues to move in the radial direction until the dynamic cutter contacts the limit stop as previously described. In this position the dynamic cutter's radial position is greater than the radius of the stabiliser blade 20.

The piston seal 22 is located in the drill bit body. This seal 22 may be of an o-ring design, a lipped design with a leading or trailing lip or both or any other known type of seal. An exit port 48 is provided in the piston extending from one end of the piston to the other to allow the hydraulic fluid to pass from the cavity 44 to the exterior of the drill bit body. This also enables the piston to return to its inner radial position once the rotary disc valve 42 is closed. The diameter of the exit port 48 is less than the diameter of the feed port 53 in order to create a pressure differential across the piston. In an alternative embodiment, this hydraulic system could also be used without the piston seal 22, such that the fluid exits past the piston. In such an arrangement the exit port 48 may not be required.

Figure 7:
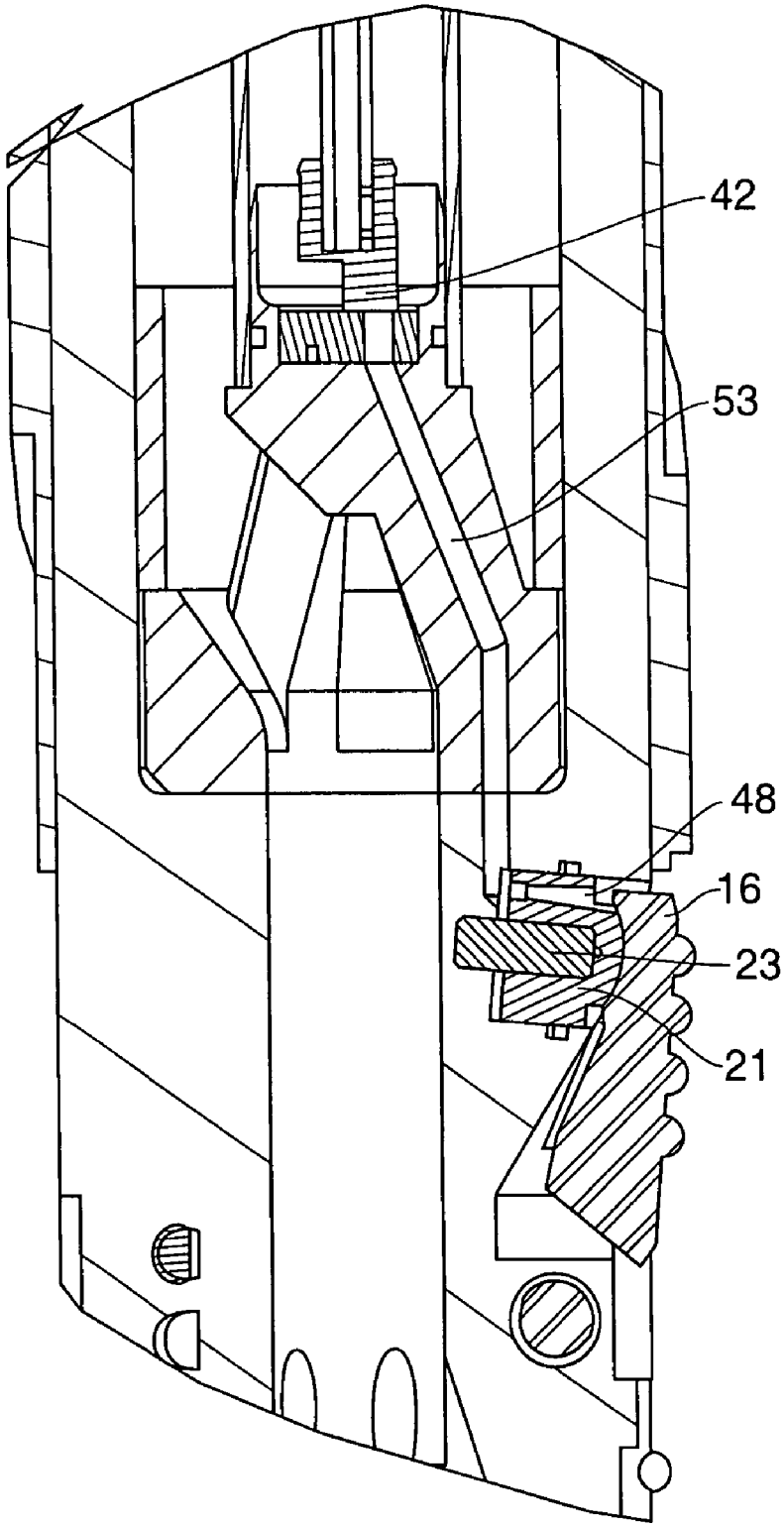
FIG. 7 is a detailed view of the dynamic cutter of FIG. 6 which shows a cutting blade retracted to an inner radial position.

FIG. 7 shows the dynamic cutter 16 in the radially-inner position. When the disc valve 42 rotates relative to the drill bit body there is a period during which the flow of fluid to the feed port 53 is stopped and the fluid in the cavity vents to the low pressure zone outside the drill bit body through the piston exit port 48. The dynamic cutter 16 and piston 21 are returned to the radially-inner position of FIG. 7. In order to advance the hole being drilled the drilling tool is pressed into the rock formation with a force commonly known as weight-on-bit (WOB). This results in a reaction force between the drill bit cutters and the rock formation. Similarly a reaction exists between dynamic cutters and the rock formation. When the disc valve 42 closes this reaction force will cause the dynamic cutter to return to its inner radial position. The inner radial position is controlled by engagement of the piston 21 with the guide pin 23 and engagement of the dynamic cutter 16 with the piston 21. In this position the outermost radial point of the dynamic cutter is less than the stabiliser radius. The dynamic cutter will remain in this position until the rotary disc valve 42 returns to the open position.

Figure 7A:
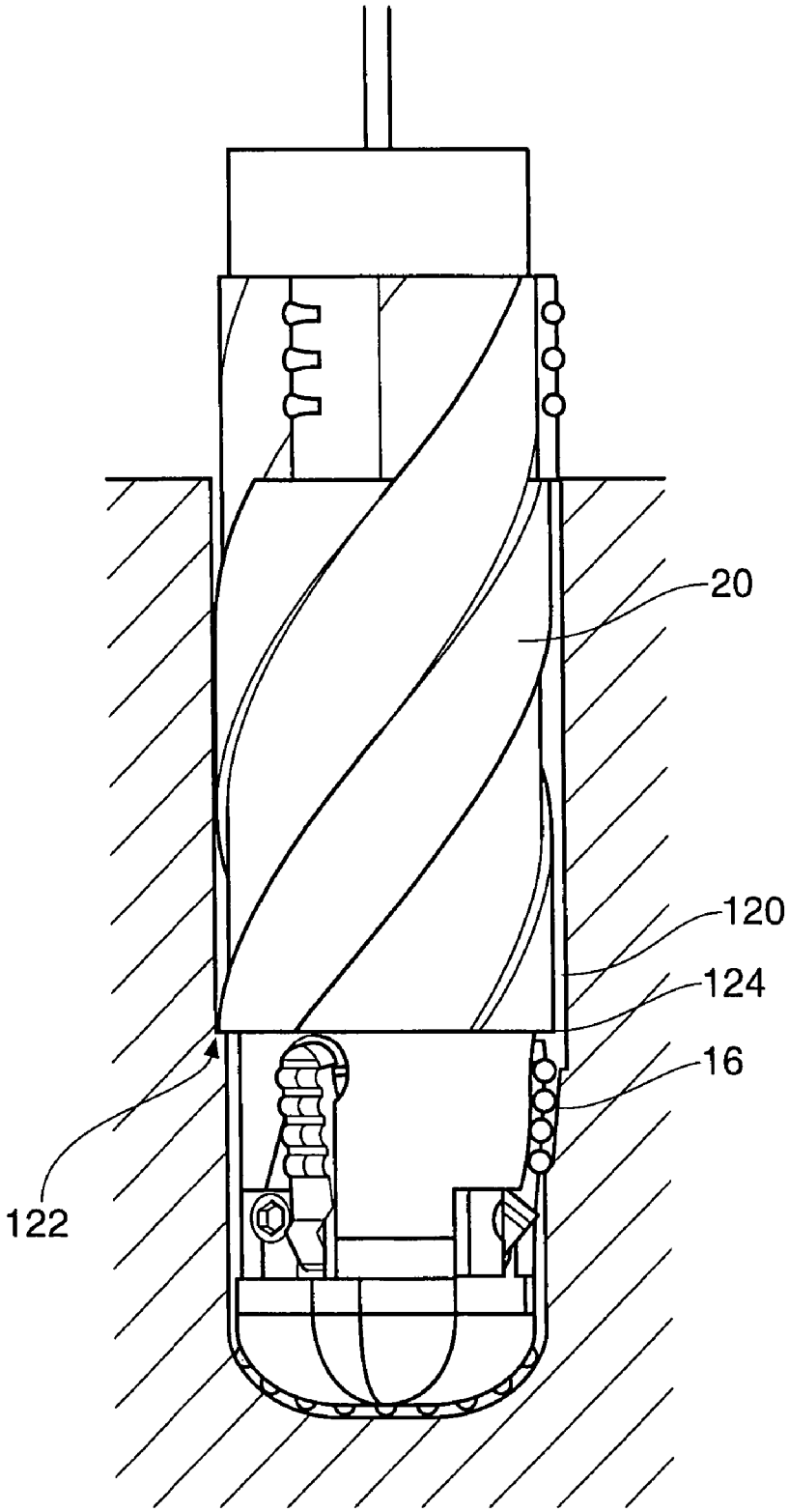
FIG. 7A is a schematic view of a bore hole being drilled with a directional drilling system according to an embodiment of the present invention.

FIG. 7A illustrates schematically the manner of operation of a directional drilling device and tool according to the present invention to re-direct a drill head. This drawing is not to scale and simply illustrates the manner in which the device is influential to effect re-direction of the drill head.

When it is desired to change the direction of drilling, the rotational position of the disc valve 42 is adjusted relative to the drill bit body for eccentric cutting as previously described.

In one example of a typical drill, the cutting diameter of the cutting elements 15 defines a bore of approximately 14 cm (5.5 inches), while the cutters 16, when extended, can cut a channel in a defined arcuate sector 120 from the bore wall at a maximum distance from the axis of rotation of the drill of about 7.6 cms (3.0 inches). Depending upon the disposition of the cutters 16, such a sector 120 will effectively be crescent shaped when viewed in plan (i.e. normal to the axis of rotation).

The stabiliser 20, following the cutters 16 is of an external cutting diameter, which lies between that of the drill head and the maximum cutting distance of the cutters 16 at 14.6 cms (5.75 inches).

It is to be clearly understood that these dimensions are not intended to be limitative of the invention and serve only as an example.

When the drill is descending linearly, the forces and their reactions acting on the drill head are evenly distributed around the drilling axis and do not affect the linear progress of the drill head. When it is desired to re-direct the drilling axis a segment or sector 120 of the bore wall is removed by the cutters 16 as previously described. As drilling progresses a near bit stabiliser, located above and behind the dynamic cutters, contacts with the portion of well bore which was not removed with the dynamic cutters, i.e. the concentric part. This contact exerts a force onto the near bit stabiliser which is reacted by the drill bit and another stabiliser further up the drill string. The reaction force between the drill bit and the formation results in a side cutting force on the drill bit and hence deviation of the drill bit is achieved.

The movable or dynamic cutters 16 must, as will be appreciated from the above, be deployed in their extended positions in synchronisation with rotation of the drill until the required angle of deviation has been achieved. The deviation can be measured by measuring devices 9 in the drill string to the rear of the drill bit.

Figure 8:
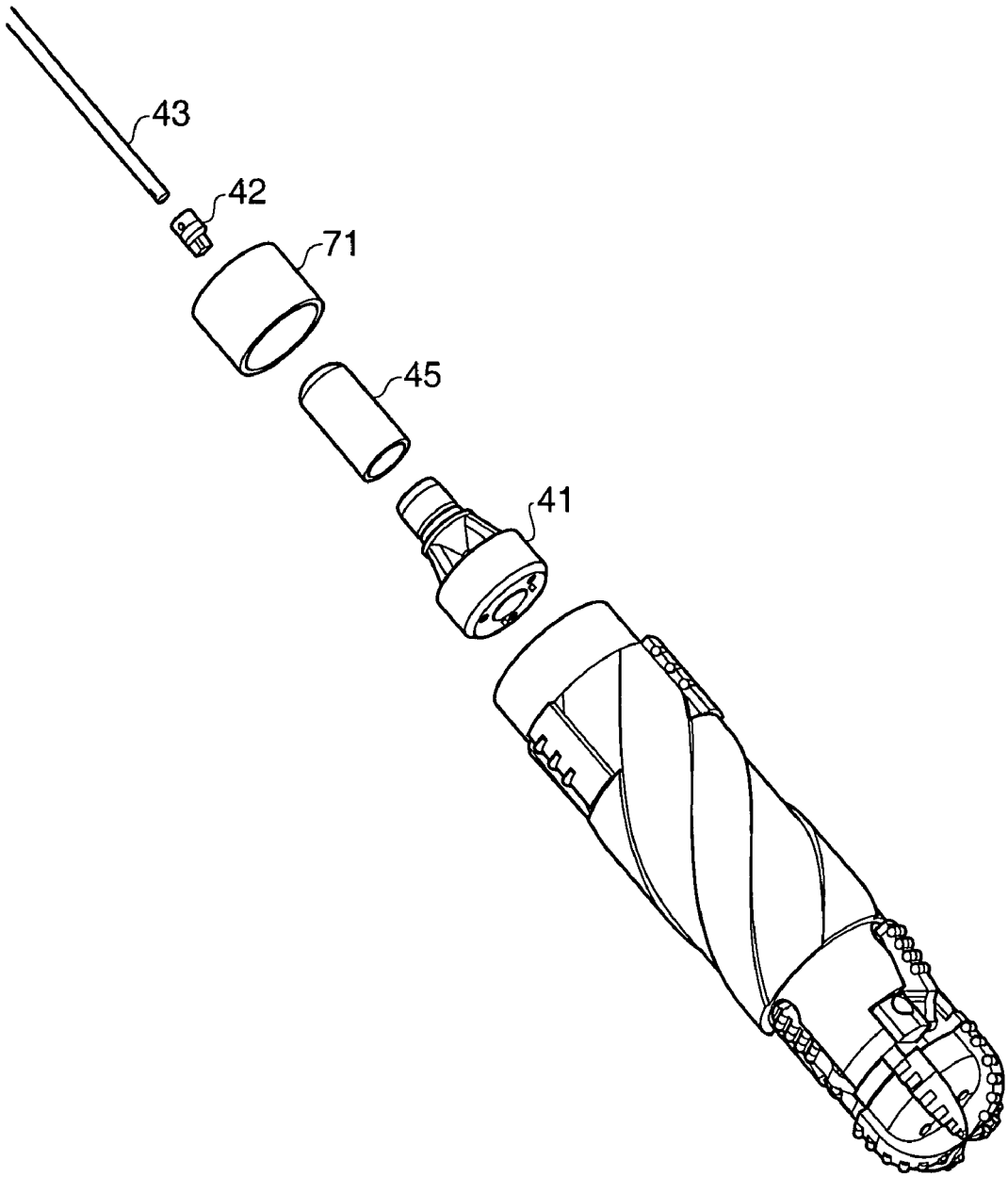
FIG. 8 is an exploded view of the directional drilling system of FIGS. 2 to 7 showing a control valve, filter and fluid distributor of the drill bit.

FIG. 8 shows an exploded view of the fluid distributor 41, filter 45, rotary disc valve 42 and control shaft 43. The fluid distributor 41 is held in place, that is to say is fixed with respect to the drill bit body, by a locking ring 71 which has an external thread (not shown) which engages an internal thread (not shown) in the drill bit body. The filter 45 has an internal thread (not shown) which engages an external thread (not shown) on the fluid distributor 40. The rotary disc valve 42 is attached to the valve control shaft 43 by a keyway or other known arrangement.

Figure 9:
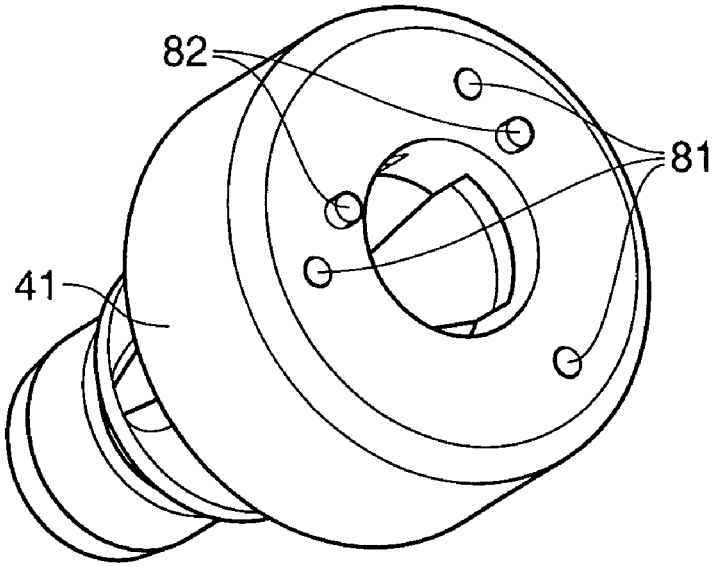
FIG. 9 is a detailed perspective view of the rotary disc valve and fluid distributor shown in FIG. 8.
Figure 10:
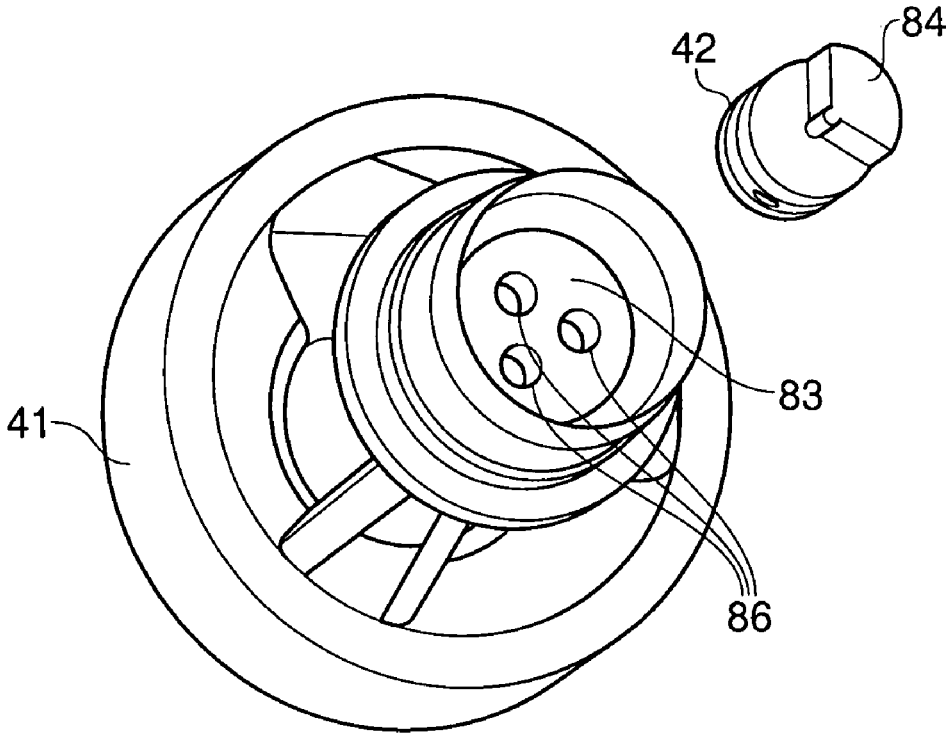
FIG. 10 is a detailed perspective view of the rotary disc valve and fluid distributor shown in FIG. 8.

Referring to FIGS. 9 and 10 which show the fluid distributor 41 and rotary disc valve 42, the fluid distributor 41 comprises a series of feed ports 81 corresponding to the number of dynamic cutters 16 on the drill bit body. The feed ports are located in the end face of the fluid distributor at the end of the respective internal fluid communication passages 53. In this example three are shown. The feed ports 81 are used to channel the hydraulic fluid from the rotary disc valve to the feed ports 56 in the drill bit body. Two pins 82 are provided for engagement with two corresponding holes (not shown) in the drill bit body to ensure the feed ports in the fluid distributor are aligned angularly with the feed ports in the drill bit body when assembled together.

FIG. 10 shows the rotary disc valve 42 and fluid distributor 41. When assembled together the rotary disc valve face 84 contacts the feed port face 83, that is to say, in FIG. 10, the valve 42 has been rotated 180° degrees from its normal orientation with respect to the fluid distributor to show the detail of the end face 84 which, in its assembled position, engages the end face 83 of the distributor 41. The diameter of the cylindrically shaped valve 42 is less than the internal diameter of that part of the distributor in which it is located so that fluid may pass between the outer periphery of the valve 42 and the inner circumference of the upstanding cylindrical pivot of the distributor in which the valve is located. This is best shown in the cross-section views of FIGS. 6 and 7. In use, fluid flows around the outside periphery of the rotary disc valve 42 and into those ports 86 which are not closed off by the rotary disc valve face 84. As the rotary disc valve 42 rotates with respect to the drill bit body each successive port will be closed off in turn and fluid allowed to enter the two remaining ports. The mating surfaces of the port face 83 and rotary disc valve face 84 could be coated in a hard wearing material or manufactured from polycrystalline diamond in order to reduce wear. The rotary disc valve is shown with an open period of 240 degrees. Therefore with each rotation of the drill bit body the dynamic cutters are displaced radially outwards for 240 degrees of each rotation and are retracted for the remaining 120 degrees of rotation. The opening period could be more or less than this depending on the shape of the eccentric hole to be produced by the dynamic cutters.

As previously described the rotary disc valve is required to open and close to allow fluid within the drill string to flow to the pistons in the drill bit body, including any restraining pistons provided to limit the effect of the primary pistons. When operating synchronously with rotation of the drill, the rotary disc valve is required to open and close at the same angular position with each rotation of the drill bit body in order to deploy the dynamic cutters at the same angular position with each rotation of the drill bit body. This is achieved by holding the rotary disc valve geostationary about the rotating drill bit body. Therefore, as the drill bit body rotates, a piston feed port 53 will rotate and become open allowing the fluid to flow to the piston cavity. As the drill bit body continues to rotate, the feed port will remain open for 240 degrees of rotation when the disc valve will shut off the flow to that piston. In the meantime another feed port will appear and allow fluid to flow to the next piston and so on.

In an alternative embodiment of the invention shown in FIG. 6A, A secondary piston-and-cylinder arrangement 101 may be provided for acting on a respective dynamic cutter to limit outward movement about the pin 28 and to assist in rapid movement of the cutters from their radially outer first positions to their second, radially inner, positions. By way of example, the secondary piston-and-cylinder arrangement 101 may act on a shoulder 16A of an extended form of the cutter 16 or other part adapted to engage such piston. Such a piston would act continuously to counter part of the force exerted by the piston 21. The secondary piston-and-cylinder arrangement is, in operation, permanently biased against the shoulder 16A so that during those periods when the cutter is not subjected to biasing pressure, it can be active to move the cutter instantly to its second, inner, radial position. The bias of the piston is provided by hydraulic pressure of fluid in the string ducted through or past the valve 42 permitting supply of hydraulic fluid direct to the cylinder of the arrangement 101 via a conduit 102.

In order to hold the rotary disc valve geostationary, a roll stabilised electronics platform could be used, as described in UK patent application number 9213253, or a strapped down electronics system could be used such as those commonly found in Measurement While Drilling tools (MWD) with an electric motor providing the rotational control for the rotary disc valve control shaft.

Figure 11:
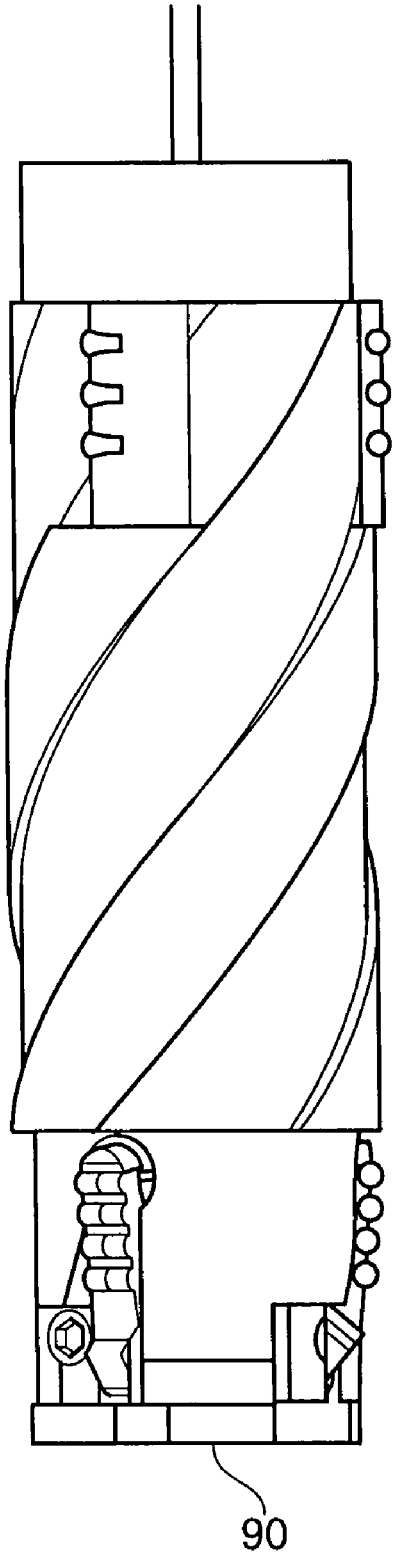
FIG. 11 shows a directional drilling system for use with conventional drill bit.

The dynamic cutters have been shown to be a part of a drill bit body which also includes the drill bit cutters 15 as shown in FIG. 2. The present invention also contemplates embodiments in which the drill bit body comprises a separate assembly which is attached to the bottom of a dynamic cutters body 90 shown in FIG. 11, as is commonly the case in most rotary steerable systems. This would allow the use of any existing or conventionally designed form of drill bit with the dynamic cutting tool of the present invention. Furthermore the present invention is not limited to PDC bits; a roller cone or natural diamond bit or any other suitable cutter material could be used.

Although aspects of the invention have been described with reference to the embodiment shown in the accompanying drawings, it is to be understood that the invention is not limited to that precise embodiment and various changes and modifications may be effected without further inventive skill and effort. For instance, it is to be understood that the rotary disc valve is only one means of controlling the fluid flow to the dynamic cutter actuating pistons and is shown by way of example only. It will be appreciated that other forms of hydraulic switching mechanisms could be employed.

The use of hydraulic pistons for deploying the dynamic cutters from the inner to outer radial position is shown by way of example and it will be appreciated that other arrangements for mechanically deploying the cutters could by employed.

The dynamic cutters have been shown to pivot about an axis which is perpendicular and offset from the axis of rotation of the drilling tool.

The pivot point could be either up or down hole of the actual dynamic cutters. The pivot point could contain a hard wear resistant sleeve or a soft sacrificial sleeve. The pivot point could be integrated into the drilling tool body or be a separately attached component.

Other axes could be used such as one which is parallel and offset from the drilling tool axis of rotation. In this case the pivot axis could either lead or follow the actual cutting face on the dynamic cutters. Again the pivot point could contain a hard wear resistant sleeve or a soft sacrificial sleeve and pivot point could be integrated into the drilling tool body or be a separately attached component.

The dynamic cutters are shown in the drawings with the piston or force application point and cutting elements on the same side of the pivot point. The dynamic cutters could be provided by deploying dynamic cutters having a pivot point between the force application point and cutting elements.

An alternative method would be to allow the dynamic cutters to slide radially outward on guide pins or rods. The cutter outer radial position would be controlled by contacting with the drilling tool body. A wear resistant material could be used on the guide pins and piston to prolong their life.

The dynamic cutters could also be displaced from the inner to outer radial position by use of a multi bar linkage which is attached to both the drilling tool body and the dynamic cutters.

The dynamic cutters could also be displaced by sliding on a plane surface which is inclined to the rotational axis of the drilling tool. By sliding the cutters on this plane surface the radial position could be changed from the inner positions to their outer positions.

The dynamic cutters could be allowed to return to their inner positions by the forces exerted from the formation being drilled or by mechanical means such as springs or differential pressure or magnetic force.

The movement of the dynamic cutters from the inner to outer positions could be provided by the following means:

A hydraulic piston could be used with the fluid source being either the mud in the drill string having a differential pressure between the inside and outside of the drill string. In this case the fluid would be lost to the annulus of the drill string after a piston has been energised, this is commonly known as an open system. The piston could be either physically or mechanically attached to the dynamic cutters or consist of a separate component from the cutters. The piston could either operate in a toroidal bore or a linear bore. The piston seal could be either attached to the piston or the drilling tool body. The piston could be made from a wear resistance material or coated with such a material, the piston seal being made from a polymer or other sealing material which are commonly used in drilling tools.

Furthermore a closed system using hydraulic oil which is recycled and reused after each piston is energised could be used. Means for creating a hydraulic pressure differential would be required such as a linear actuation pump or rotary pump. Means for storing the hydraulic fluid on the lower pressure side would be required such as a reservoir. A valve would be required to control the movement of fluid from the pump to the pistons.

A valve for use in either the open or closed systems could be placed in either the inflow or outflow paths of the piston which could consist of either a rotary disc valve, linear piston type valve, sliding gate valve, poppet or plunger type of valve.

The valves could be operated by electrically controlled devices such as solenoids or stepper motors or electromechanical ratcheting devices.

The dynamic cutter movement could also be provided by mechanical means, for example a cam could be used to move a respective cutter from the inner to outer position. The cam would be held geo-stationary on the axis of rotation of the drilling tool and a rocker or plunger would be used to transmit the radially force from the cam onto the dynamic cutter. The cam would be held geo-stationary by an electromechanical device such as a servo motor.

A scotch-yoke could be used to produce a linear motion to which each dynamic cutter is attached. The dynamic cutters could then either pivot as described above or be guided on pins.

The dynamic cutters could also move from their inner to outer radial positions by using a rack and pinion or ball and screw. A servo motor would be used to provide the rotary motion.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

I claim:

1. A directional drilling device for use in drilling boreholes, the device having a singular axis of rotation and being positionable between a drill bit and associated drill collar of a drill string having a longitudinal drilling axis; the device comprising:

at least one cutting member movably mounted with respect to a body member, the at least one cutting member being moveable between a first extended position for engagement with the wall of a bore hole and a second position in which it is retracted from engagement with said wall;

directional control means for synchronizing the movement of the at least one cutting member between said respective extended and retracted positions in accordance with the rotational position of the body member in the bore hole being drilled to cut a void to create an eccentric channel about the longitudinal drilling axis; and a stabilizing means extending around the body member and having a larger radial diameter than the at least one cutting member when in the second position and operable to contact with the bore hole to steer the drilling device in the direction of the eccentric channel.

2. A drilling device according to claim 1, wherein said control means comprises a hydraulic or pneumatic circuit for moving the at least one cutting member between said first and second positions.

3. A drilling device according to claim 2, wherein said hydraulic circuit comprises a valve means for selectively moving the at least one cutting member between said respective positions.

4. A drilling device according to claim 3, wherein said valve means comprises a rotary valve for selectively moving the at least one cutting member between said respective positions in dependence on the relative rotational position of the said valve with respect to the said body member.

5. A drilling device according to claim 3, wherein said valve means comprises at least one of an electromagnetic solenoid, gate, ball, or cylindrical valve for selectively moving the at least one cutting member between said respective positions.

6. A drilling device according to claim 3, wherein the at least one cutting member is provided with a respective hydraulic piston-and-cylinder actuator for moving and maintaining the at least one cutting member in its first extended position, the said cylinder being hydraulically coupled to the said valve means.

7. A drilling device as claimed in claim 6, wherein the said piston is slidably mounted on a guide fixed in relation to the said body member.

8. A drilling device as claimed in claim 7, wherein the said piston is slidably mounted on guide pin fixed in relation to the said body member.

9. A drilling device as claimed in claim 6, wherein a seal is provided between the said piston and the said cylinder.

10. A drilling device as claimed in claim 9, wherein the said seal is mounted on either the said piston or the said cylinder.

11. A drilling device as claimed in claim 6, wherein the said cylinder is provided in the said body member.

12. A drilling device according to claim 6, wherein a secondary piston-and-cylinder assembly is provided for urging at least one cutting member to its second position.

13. A drilling device as claimed in claim 1, wherein the drilling device comprises a plurality of cutting members substantially equally spaced about periphery of the body member.

14. A drilling device as claimed in claim 13, wherein three or more of the plurality of cutting members are evenly spaced about said drilling axis.

15. A drilling device as claimed in claim 1, wherein the at least one cutting member is pivotally mounted with respect to the said body member.

16. A drilling device as claimed in claim 15, wherein the at least one cutting member is pivotally mounted at or adjacent one end thereof.

17. A drilling device as claimed in claim 15, wherein the at least one cutting member is pivotally mounted with respect to the said body member on a pivot axis offset from the axis of rotation of the said device.

18. A drilling device as claimed in claim 15, wherein the at least one cutting member is pivotally mounted with respect to the said body member on a pivot axis offset from and perpendicular to the axis of rotation of the said device.

19. A drilling device as claimed in claim 1, wherein the at least one cutting member is slidably mounted with respect to the said body member for movement between said respective first and second positions.

20. A drilling device as claimed in claim 19, wherein the at least one cutting member is slidably mounted with respect to the said body member on an axis offset from and perpendicular to the axis of rotation of the said device.

21. A drilling device as claimed in claim 1, wherein the at least one cutting member is located within a respective recess provided in the said body member.

22. A drilling device according to claim 1, further comprising a stop member configured to limit movement of the at least one cutting member.

23. A drilling device or tool according to claim 1, wherein each of the at least one cutting member is movable in a radial direction relative to said drilling axis.

24. A drilling device as claimed in claim 1, wherein said stabilizing means comprises a drill string stabilizer adjacent the at least one cutting member for generating a lateral force on an associated drill bit, in use, for altering the direction of the drilling axis.

25. A drilling device according to claim 24, wherein the stabilizer is provided by a plurality of helical blades uniformly spaced around the drilling axis.

26. A drilling device according to claim 25, wherein each blade of the plurality of helical blades has an end face which is beveled.

27. A drilling device according to claim 1, wherein each of the at least one cutting member comprises an arm on which cutting elements are provided.

28. A drilling device according to claim 27, wherein the arm is mounted on a pivot pin between which and the arm is provided a bearing which is either formed of a hardwearing material, such as diamond or polycrystalline diamond, or of a sacrificial material.

29. A drilling device as claimed in claim 1, wherein the said body member comprises a drill bit head at a cutting end thereof.

30. A drill bit having a singular axis of rotation comprising:

at least one cutting member movably mounted with respect to a body member, the at least one cutting member being moveable between a first extended position for engagement with a wall of a bore hole and a second position in which it is retracted from engagement with said wall;

directional control means for synchronizing the movement of the at least one cutting member between said respective extended and retracted positions in accordance with the rotational position of the body member in the bore hole being drilled to cut a void to create an eccentric channel about a longitudinal axis; and a stabilizing means extending around the body member having a larger radial diameter than the at least one cutting member when in the second position and operable to contact with the bore hole to steer the drill bit in the direction of the eccentric channel.

31. A drill bit as claimed in claim 30, wherein the at least one cutting member of said directional drilling device are spaced longitudinally from the head or cutting tip of the drill bit.

32. A drill bit as claimed in claim 30, wherein the said body member defines a drill bit body.

33. A method of controlling the direction of drilling axis of a rotatable boring drill bit of a drill string comprising a plurality of hollow drill collars on a drilling end of which the rotatable boring drill bit is mounted, at least one movable cutter being mounted on or in the collar adjacent the rotatable boring drill bit around an axis of rotation of the drill string, the collar having a singular axis of rotation, the said at least one movable cutter being mounted for movement between a first position in which it engages a wall of a bore hole in which the rotatable boring drill bit is moving and a second position in which it is retracted from engagement with the wall, the collar having a surrounding stabilizing means having a larger radial diameter than the at least one movable cutter when in the second position, and controllably moving the at least one movable cutter as the rotatable boring drill bit is rotated so that movement of the said movable cutter is synchronized with that of the rotatable boring drill bit so that the at least one movable cutter is selectively engaged with the wall at a preselected region thereof to form a linear channel therein parallel to the drilling axis when it is desired to cause the path of the rotatable boring drill bit to deviate from a linear direction of movement.

34. A method according to claim 33 wherein movement of the at least one movable cutter is effected by exerting hydraulic pressure thereon through valve means controlled remotely from the head of the bore hole.

35. A method according to claim 34, wherein selective engagement of said at least one movable cutter is synchronized with rotation of the drill string in which the said at least one movable cutter is mounted to enable the said at least one movable cutter to operate selectively on the preselected region of the wall of the bore hole.

36. A method according to claim 33, wherein selective engagement of said at least one movable cutter is synchronized with rotation of the drill string in which the said at least one movable cutter is mounted to enable the said at least one movable cutter to operate selectively on the preselected region of the wall of the bore hole.

37. A directional drilling device for use in drilling boreholes, the device being positionable between a drill bit and associated drill collar of a drill string having a longitudinal drilling axis; the device comprising:

at least one cutting member movably mounted with respect to a body member, the at least one cutting member being moveable between a first extended position for engagement with the wall of a bore hole and a second position in which it is retracted from engagement with said wall; and directional control means for synchronizing the movement of the at least one cutting member between said respective extended and retracted positions in accordance with the rotational position of the body member in the bore hole being drilled;

wherein said control means comprises a hydraulic or pneumatic circuit for moving the at least one cutting member between said first and second positions;

wherein said hydraulic circuit comprises a valve means for selectively moving the at least one cutting member between said respective positions; and wherein the at least one cutting member is provided with a respective hydraulic piston-and-cylinder actuator for moving and maintaining the at least one cutting member in its first extended position, the said cylinder being hydraulically coupled to the said valve means.

38. A drilling device as claimed in claim 37, wherein the said piston is slidably mounted on a guide fixed in relation to the said body member.

39. A drilling device as claimed in claim 38, wherein the said piston is slidably mounted on guide pin fixed in relation to the said body member.

40. A drilling device as claimed in claim 37, wherein a seal is provided between the said piston and the said cylinder.

41. A drilling device as claimed in claim 40, wherein the said seal is mounted on either the said piston or the said cylinder.

42. A drilling device as claimed in claim 37, wherein the said cylinder is provided in the said body member.

43. A drilling device according to claim 37, wherein a secondary piston-and-cylinder assembly is provided for urging at least one cutting member to its second position.

44. A directional drilling device for use in drilling boreholes, the device being positionable between a drill bit and associated drill collar of a drill string having a longitudinal drilling axis; the device comprising:

at least one cutting member movably mounted with respect to a body member, the at least one cutting member being moveable between a first extended position for engagement with the wall of a bore hole and a second position in which it is retracted from engagement with said wall; and directional control means for synchronizing the movement of the at least one cutting member between said respective extended and retracted positions in accordance with the rotational position of the body member in the bore hole being drilled;

wherein each of the at least one cutting member comprises an arm on which cutting elements are provided; and wherein the arm is mounted on a pivot pin between which and the arm is provided a bearing which is either formed of a hardwearing material, such as diamond or polycrystalline diamond, or of a sacrificial material.

45. A method of controlling the direction of drilling axis of a rotatable boring drill bit of a drill string comprising a plurality of hollow drill collars on a drilling end of which the drill bit is mounted, at least one movable cutter being mounted on or in the collar adjacent the drill bit around an axis of rotation of the drill string, the said at least one movable cutter being mounted for movement between a first position in which it engages a wall of a bore hole in which the drill bit is moving and a second position in which it is retracted from engagement with the wall, and controllably moving the at least one movable cutter as the drill bit is rotated so that movement of the said movable cutter is synchronized with that of the drill bit so that the at least one movable cutter is selectively engaged with the wall at a preselected region thereof to form a linear channel therein parallel to the drilling axis when it is desired to cause the path of the drill bit to deviate from a linear direction of movement;

wherein movement of the at least one movable cutter is effected by exerting hydraulic pressure thereon through valve means controlled remotely from the head of the bore hole.

46. A method according to claim 45, wherein selective engagement of said at least one movable cutter is synchronized with rotation of the drill string in which the said at least one movable cutter is mounted to enable the said at least one movable cutter to operate selectively on the preselected region of the wall of the bore hole.

47. A method of controlling the direction of drilling axis of a rotatable boring drill bit of a drill string comprising a plurality of hollow drill collars on a drilling end of which the drill bit is mounted, at least one movable cutter being mounted on or in the collar adjacent the drill bit around an axis of rotation of the drill string, the said at least one movable cutter being mounted for movement between a first position in which it engages a wall of a bore hole in which the drill bit is moving and a second position in which it is retracted from engagement with the wall, and controllably moving the at least one movable cutter as the drill bit is rotated so that movement of the said movable cutter is synchronized with that of the drill bit so that the at least one movable cutter is selectively engaged with the wall at a preselected region thereof to form a linear channel therein parallel to the drilling axis when it is desired to cause the path of the drill bit to deviate from a linear direction of movement;

wherein selective engagement of said at least one movable cutter is synchronized with rotation of the drill string in which the said at least one movable cutter is mounted to enable the said at least one movable cutter to operate selectively on the preselected region of the wall of the bore hole.

* * * * *

UNITED STATES PATENT AND TRADEMARK OFFICE

CERTIFICATE OF CORRECTION

PATENT NO. : 7,849,936 B2
APPLICATION NO. : 11/891541
DATED : December 14, 2010
INVENTOR(S) : Richard Hutton It is certified that error appears in the above-identified patent and that said Letters Patent is hereby corrected as shown below:

Page 1, Section (30) is missing and should read as follows:

-- (30) Foreign Application Priority Data

Feb. 11, 2005 (GB).....0503742.9 --

Signed and Sealed this
Tenth Day of May, 2011

David J. Kappos

David J. Kappos
*Director of the United States Patent and Trademark Office*